US006695196B2

(12) United States Patent
Hamada et al.

(10) Patent No.: US 6,695,196 B2
(45) Date of Patent: Feb. 24, 2004

(54) NAIL DRIVER

(75) Inventors: Masao Hamada, Hitachinaka (JP); Kaoru Ichikawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/940,618

(22) Filed: Aug. 29, 2001

(65) Prior Publication Data

US 2002/0027150 A1 Mar. 7, 2002

(30) Foreign Application Priority Data

Sep. 1, 2000 (JP) ..... 2000-265217

(51) Int. Cl.[7] ..... B25C 1/18
(52) U.S. Cl. ..... 227/119; 227/120; 227/130
(58) Field of Search ..... 227/8, 113, 119, 227/120, 130

(56) References Cited

U.S. PATENT DOCUMENTS 5,205,457 A * 4/1993 Blomquist, Jr. ..... 227/130
5,495,973 A * 3/1996 Ishizawa et al. ..... 227/8
5,647,525 A * 7/1997 Ishizawa ..... 227/113
6,145,727 A * 11/2000 Mukoyama et al. ..... 227/130

* cited by examiner

*Primary Examiner*—Scott A. Smith
*Assistant Examiner*—Nathaniel Chukwurah
(74) *Attorney, Agent, or Firm*—McDermott, Will & Emery

(57) ABSTRACT

The inner surface of a nozzle of a nail driver has a taper in the driving direction near the output nozzle thereof to direct a tip of the nail toward an axis of the nozzle when the tip of the nail contacts with the taper to always drive the nail into a board perpendicularly.

8 Claims, 11 Drawing Sheets

NAIL DRIVER

BACKGROUND OF THE INVENTION

1. Field of the Invention

This invention relates to a nail driver for driving a nail on a material with a driving power.

2. Description of the Prior Art

Nail drivers for nailing with driving power are known. Such a nail driver has a piston and a driving unit for hitting a nail to drive a nail into a material. FIG. 9 is a sectional view of such a prior art nail driver which includes an outputting portion having a cylinder and a piston for generating a drive force from a pneumatic force, a handle portion perpendicularly extending from the outputting portion, a magazine for containing nails 50 which are intermittently supported along wires 10, and a nose portion 4 including a tubular nozzle 105 for guiding the nail 50 received from the magazine 3 and hit by the piston 8.

The nail 50 is supplied to the nozzle 105 through an opening 6 at a rear portion of the nozzle 105 by a supplying mechanism 7 including an air cylinder and an air piston. The nail 50 supplied to the nozzle 105 is struck by piston 8. The bore of the nozzle 105 is generally made as small as the head of the nail 50 can just pass therethrough.

The nail 50 travels along the wall of the nozzle 105 so that almost all nails 50 are driven into a board 9 perpendicularly as shown in FIGS. 15 and 16. However, the struck nail 50 may be inclined from the axis of the nozzle 105 as shown in FIG. 11. Such a nail is driven into the board 9 with inclination as shown in FIGS. 12 and 13.

Referring now to FIGS. 9 to 14, we illustrate this operation more specifically. The nails 50 are linked with wires 10 and successively supplied to the nozzle 105 through the magazine 3. The piston 8 is rapidly driven downwardly (in the drawings) in response to a trigger. Next, the piston 8 hits the nail 50 so that the wires 10 are disconnected as shown in FIG. 10. The nail 50 travels downwardly together with the pieces of wires 10 through the nozzle 105. During this operation, the nail 50 may be inclined from the axis of the nozzle 105 as shown in FIG. 11 because a side of the head 51 of the nail 50 strongly may contact with the inner wall of the nozzle 105 for example. If the nail 50 is being driven by the piston 8 in this condition, the nail 50 strikes the board 9 with inclination as shown in FIGS. 12 and 13, so that the nail 50 sticks in the board 9 with bend thereof as shown in FIG. 14, wherein the head 51 is also bent. This is because the driving point is shifted from the tip 52 of the nail 50. Moreover, this causes direct hitting the board 9 by the piston 8.

This condition provides a poor appearance of the board 9 and a poor holding power. Moreover, if nails 50 for fixing a sheet 11 of which head size is relatively large and the length is relatively short are used, this erroneous operation will break the sheet 11. That is, there are problems that the nail is struck with inclination so that the driven nail is bent, and this provides a poor appearance and low holding power.

SUMMARY OF THE INVENTION

The aim of the present invention is to provide a superior nail driver.

According to the present invention, a first aspect of the present invention provides a nail driver comprising: a driving portion having a trigger and a piston coupled to a driving unit for driving a nail in a driving direction in response to said trigger; a handle connected to said driving portion; a tubular guide portion having an output nozzle for guiding said nail driven by said driving portion and outputting said nail through said output nozzle, an axis of said tubular guide portion being arranged in said driving direction; and a magazine connected to said tubular guide portion for supplying said nail to said tubular guide portion, wherein an inner surface of said tubular guide portion has a taper extending in said driving direction near said output nozzle to direct a tip of said nail toward an axis of said tubular guide portion when said tip of said nail contacts with said taper.

According to the present invention, a second aspect of the present invention provides a nail driver based on the first aspect, wherein a cross-sectional area of said taper progressively decreases in said driving direction.

According to the present invention, a third aspect of the present invention provides a nail driver based on the first aspect, wherein said inner surface further includes another taper extending in an opposite driving direction, provided upstream from said taper.

According to the present invention, a fourth aspect of the present invention provides a nail driver based on the third aspect, wherein another cross-sectional area of said another taper progressively increases in said driving direction.

According to the present invention, a fifth aspect of the present invention provides a nail driver based on the fourth aspect, wherein said taper and said another taper are arranged coaxially with said axis of said tubular guide portion.

According to the present invention, a sixth aspect of the present invention provides a nail driver based on the third aspect, wherein a first slope of said taper on a plane including said axis of said tubular guide portion makes a first angle with said axis and a second slope of said another taper on said plane makes a second angle with said axis, and said second angle is smaller than said first angle.

According to the present invention, a seventh aspect of the present invention provides a nail driver based on the sixth aspect, wherein said first angle is about 15° and said second angle is about 2°.

According to the present invention, an eighth aspect of the present invention provides a nail driver based on the third aspect, wherein a diameter of an upstream end of said another taper is equal to a diameter of a downstream end of said taper.

According to the present invention, a ninth aspect of the present invention provides a nail driver based on the third aspect, wherein said taper and said another taper is successively connected.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

With reference to FIGS. 1 to 8 and FIG. 17, a nail driver according to an embodiment of the present invention will be described.

Figure 1:
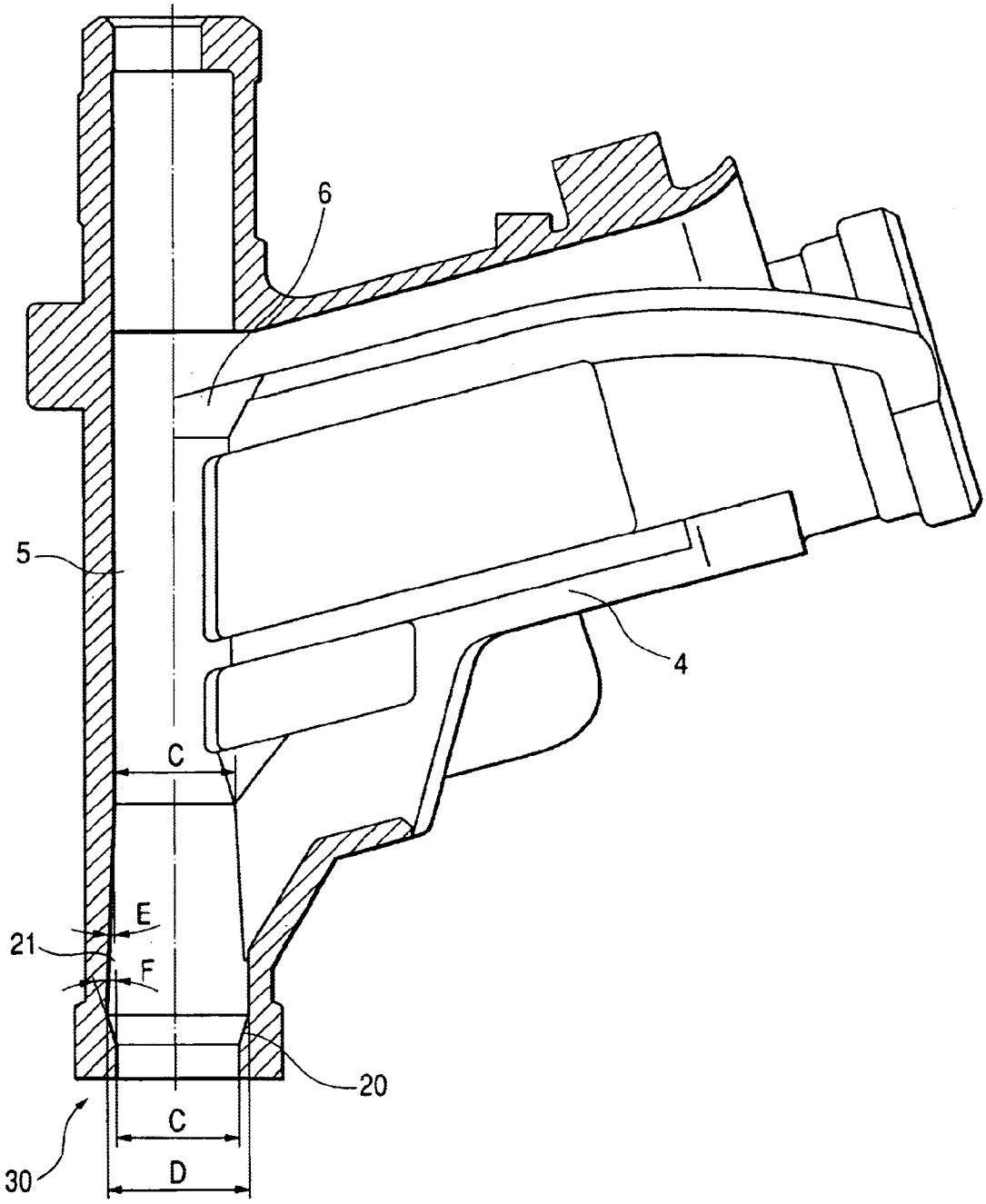
FIG. 1 is a partial sectional view mainly illustrating a nose portion of the nail driver according to the present invention.
Figure 2:
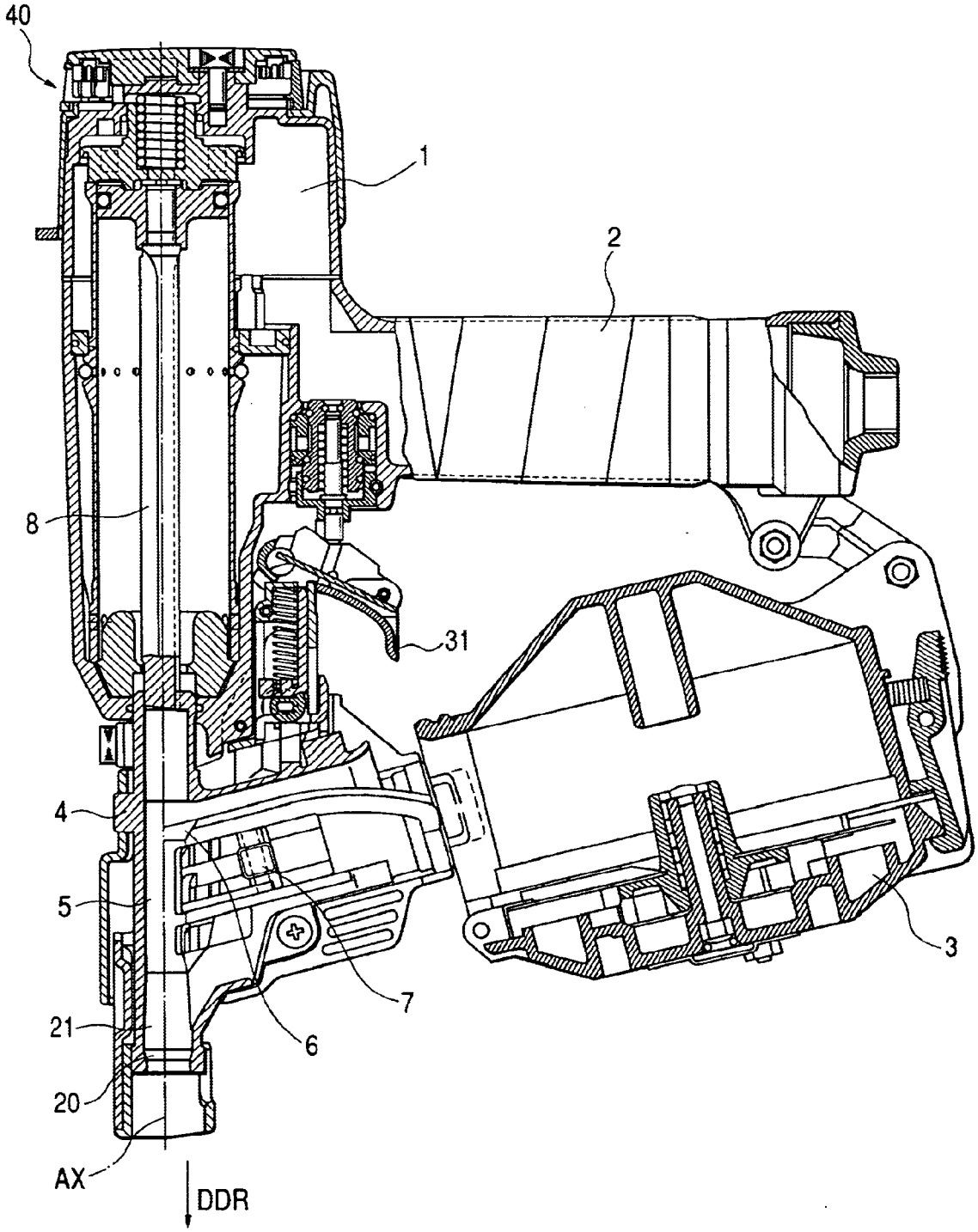
FIG. 2 is a sectional view of the nail driver according to the present invention.
Figure 3:
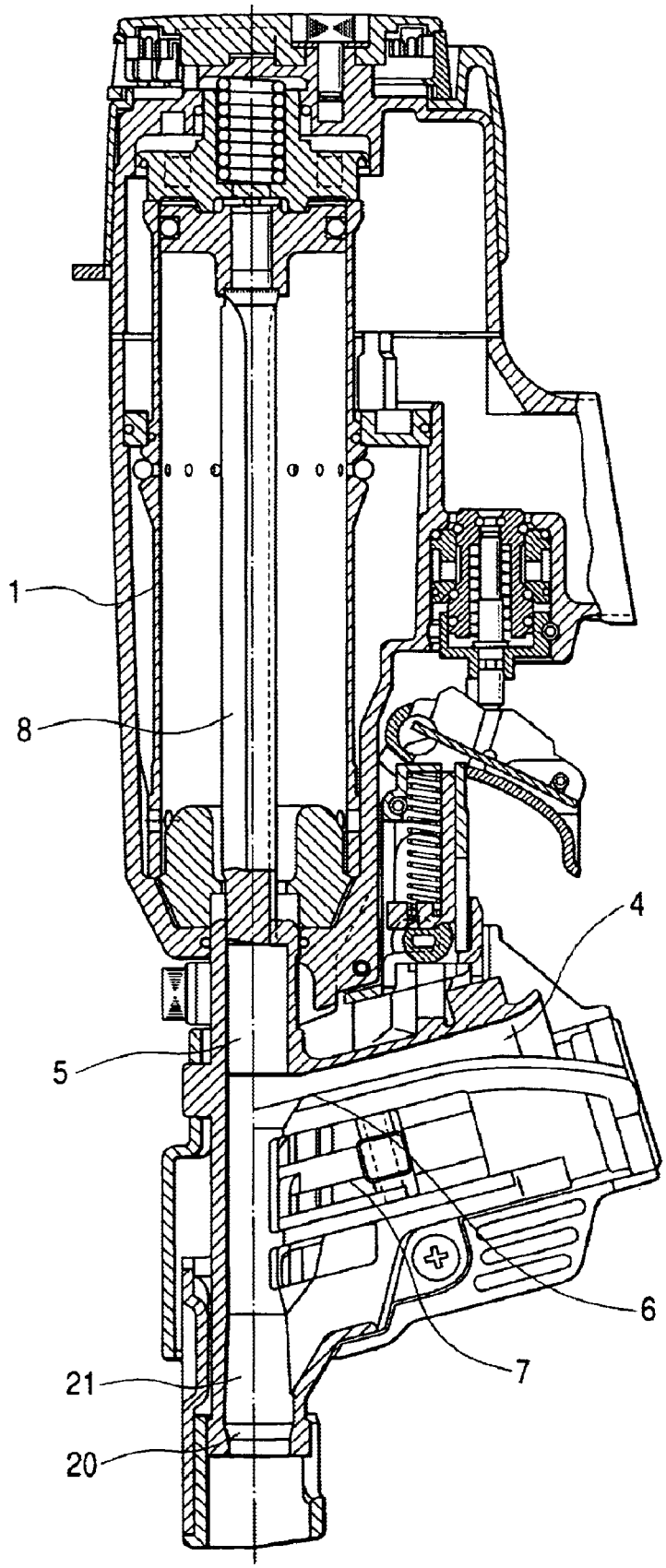
FIG. 3 is a partial enlarged sectional view of the nail driver mainly illustrating the nose portion and the driving portion according to the present invention.
Figure 4:
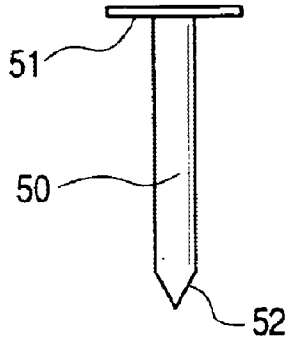
FIG. 4 PRIOR ART
FIG. 4 is a side elevational view of a nail of a prior art.
Figure 17:
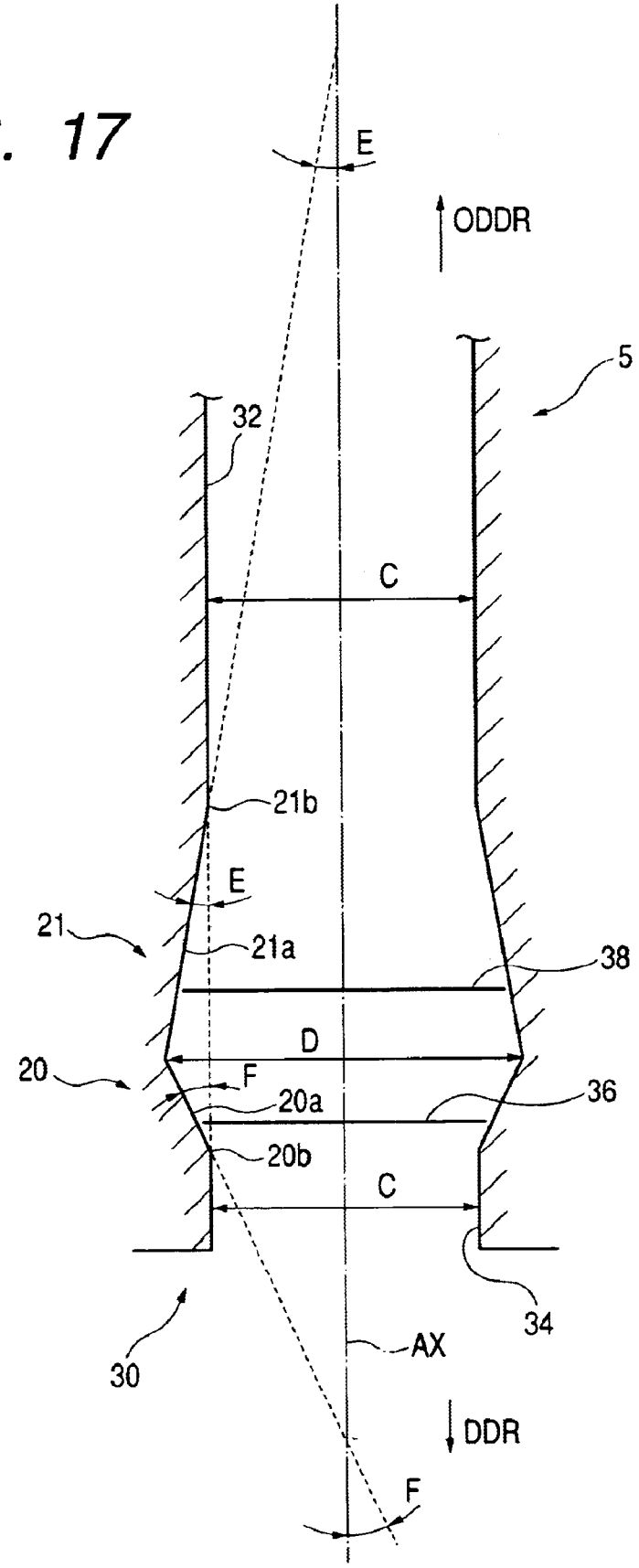
FIG. 17 is a geometric drawing of an inner surface of the nozzle on a plane including the axis of the nozzle shown in FIG. 1 according to the embodiment, wherein the angle relation is emphatically shown.

FIG. 2 shows a sectional view of the whole of the nail driver according to the present invention. FIG. 1 mainly illustrates a nose portion 4 of the nail driver shown in FIG. 2, wherein the section is taken on the plane including the axis AX of the nozzle 5 at the nose portion 4. FIG. 3 is a partial enlarged sectional view of the nail driver mainly illustrating the nose portion 4 and the driving portion 1 according to the present invention. FIG. 17 shows a geometric relation of the inner surface 32 of the nozzle 5 on the plane including the axis AX of the nozzle 5, wherein the angle relation is emphatically shown.

The nail driver includes a driving portion 1 having a trigger 31 and a piston 8 coupled to a driving unit 40 for driving or hitting a nail 50 in a driving direction DDR in response to the trigger 31. The nail driver further includes a handle 2 connected to the driving portion 1 to support the driving portion 1. A nozzle (tubular guide portion) 5 is connected to the driving portion 1. The nozzle 5 having an output nozzle 34 guides the nail 50 driven by the driving portion 1 and outputs the nail 50 through the output nozzle 34. The axis AX of the nozzle 5 is arranged in the driving direction DDR. The nail driver further includes a magazine 3 connected to the nozzle 5 for supplying the nail 50 into inside of the nozzle 5.

The nozzle 5 has an inner surface 32 having a circular cross-section (which is perpendicular to the axis AX) of which diameter is C at the upstream side of the nozzle 5 such that the diameter C is made as small as the head 51 of the nail 50 can just pass therethrough. At the tip 30 of the nozzle 5, the inner surface 32 of the nozzle 5 has a taper 20 extending in the driving direction DDR (inner diameter decreases in the driving direction) near an output nozzle 34 (near the tip 30 of the nozzle 5) to direct a tip 52 of the nail 50 toward the axis AX of the nozzle 5 when the tip 52 of the nail 50 contacts with the taper 20. The cross-sectional area 36 of the taper 20 progressively decreases in the driving direction DDR.

The inner surface 32 further includes another taper 21 extending in an opposite driving direction ODDR (a direction opposite to the driving direction DDR), provided upstream from the taper 20. Another cross-sectional area 38 of another taper 21 progressively increases in the driving direction DDR.

The maximum diameter of the inner surface 32 is D (>C) at the connection between the taper 20 and another taper 21. The taper 20 and another taper 21 are arranged coaxially with the axis AX of the nozzle 5.

The first slope 20*a* of the taper 20 on the plane including the axis AX of the nozzle 5 makes a first angle F with the axis AX and a second slope 21*a* of the another taper 21 on the plane makes a second angle E with the axis AX, and the second angle E is smaller than the first angle F. More specifically, the first angle F is about 15° and the second angle E is about 2°.

In this embodiment, a diameter of an upstream end 21*b* of another taper 21 has the diameter C which is equal to a downstream end 20*b* of the taper 20. Moreover, in this embodiment, the taper 20 and another taper 21 is successively connected.

Figure 5:
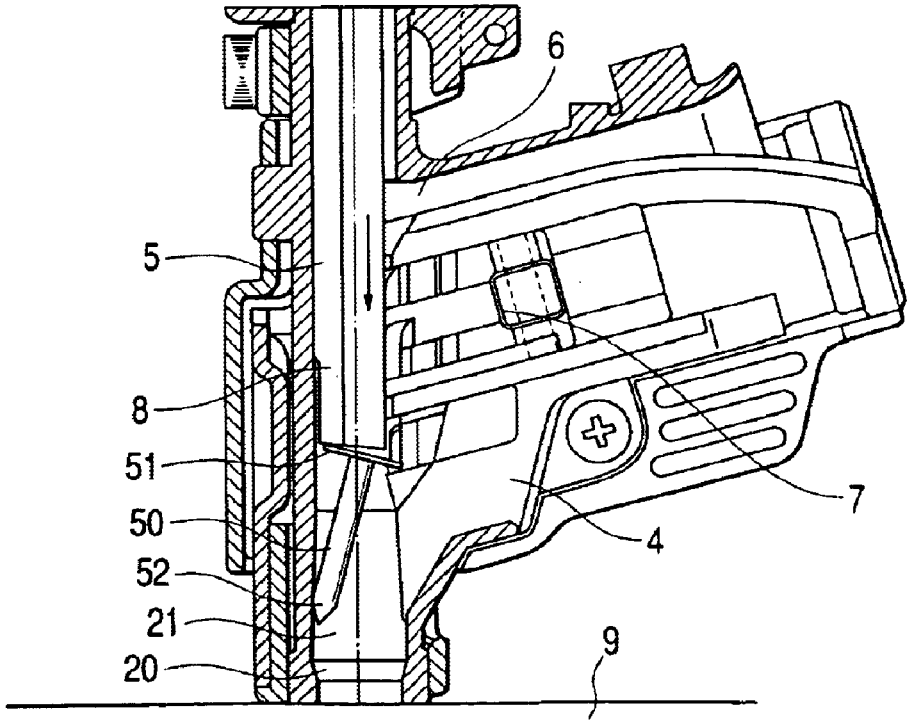
FIG. 5 is a partial sectional view of the nose portion according to the present invention, wherein the nail is inclined.
Figure 6:
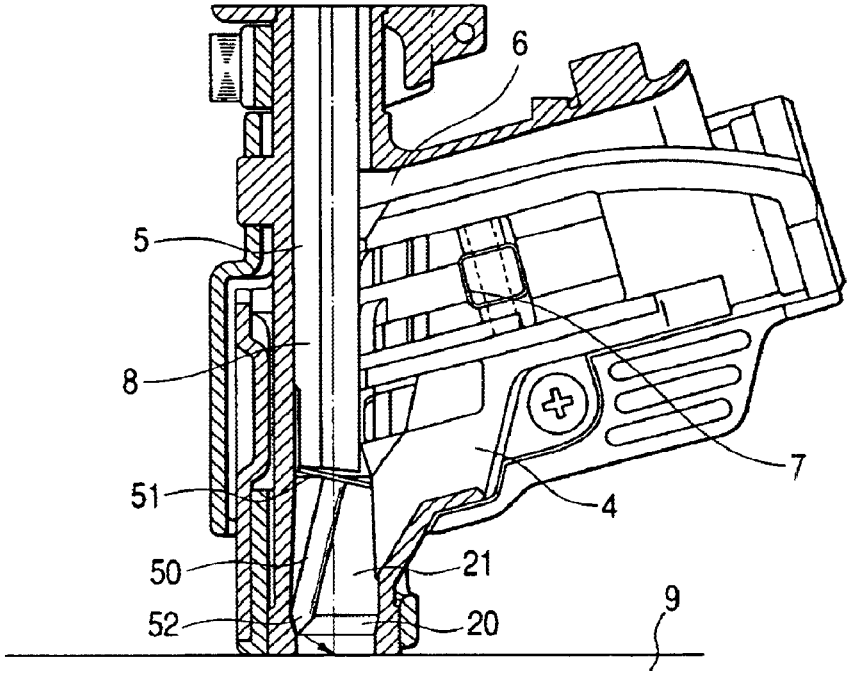
FIG. 6 is a partial sectional view of the nose portion according to the present invention, wherein a tip of the inclined nail contacts the taper.
Figure 7:
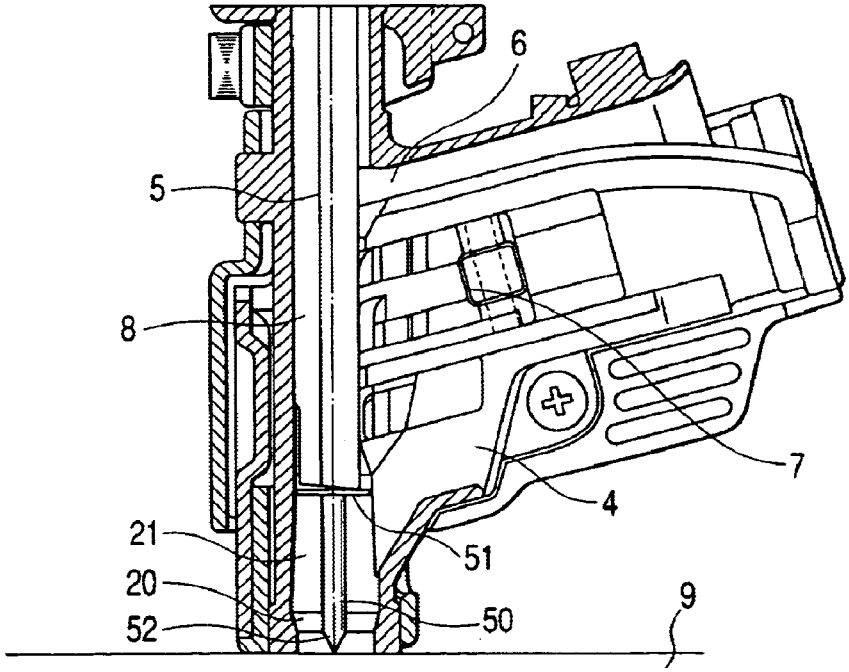
FIG. 7 is a partial sectional view of the nose portion according to the present invention, wherein the inclined nail is correctly directed.
Figure 8:
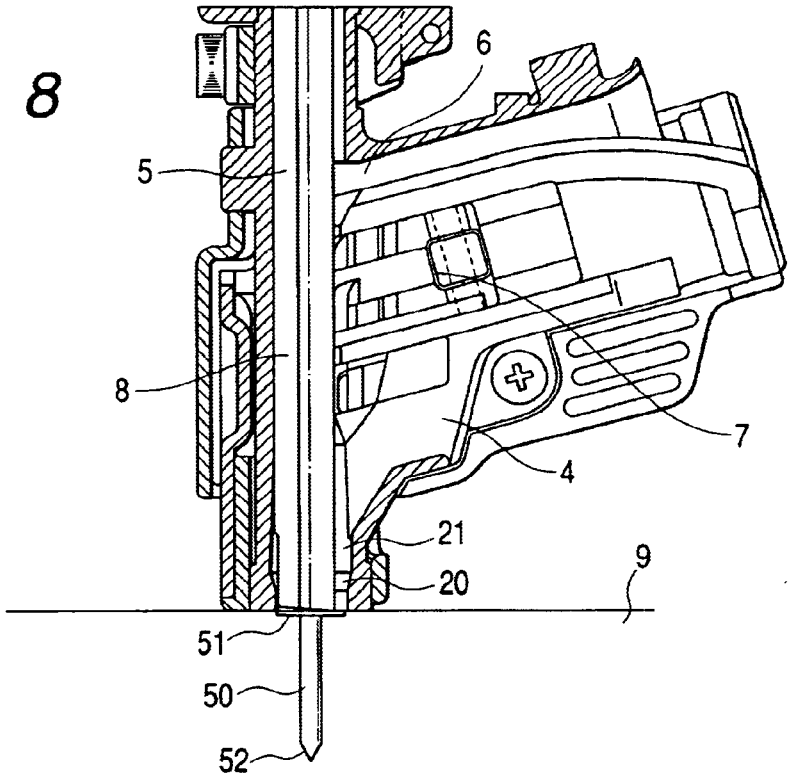
FIG. 8 is a partial sectional view of the nose portion according to the present invention, wherein the correctly directed nail stuck in the board perpendicularly.
Figure 9:
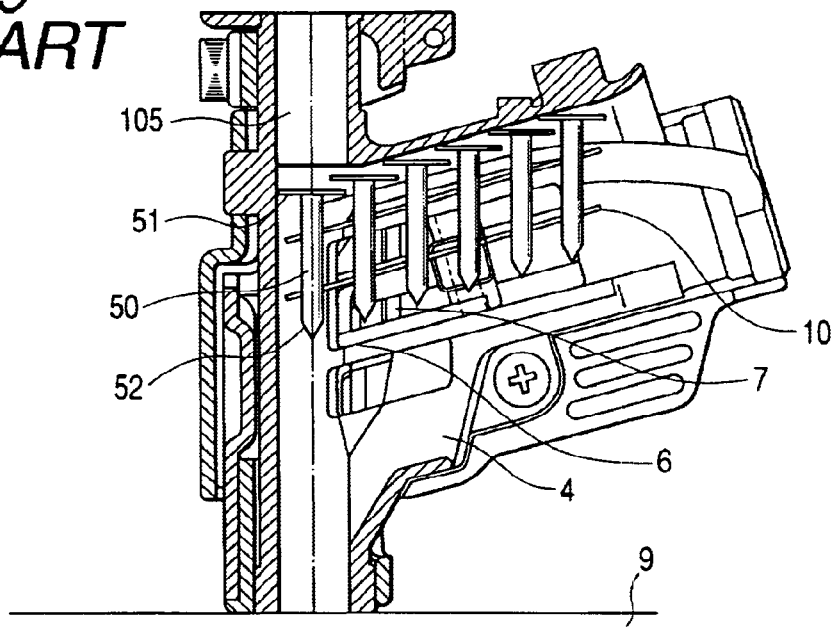
FIG. 9 PRIOR ART
FIGS. 9 to 16 are sectional view of a prior art nail driver for showing prior art operation.
Figure 10:
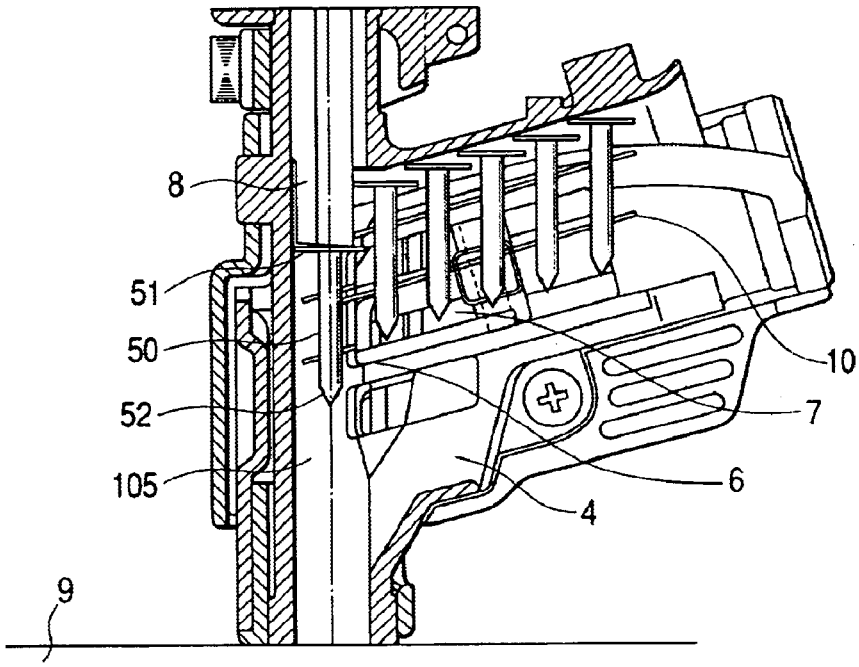
FIG. 10 PRIOR ART
Figure 11:
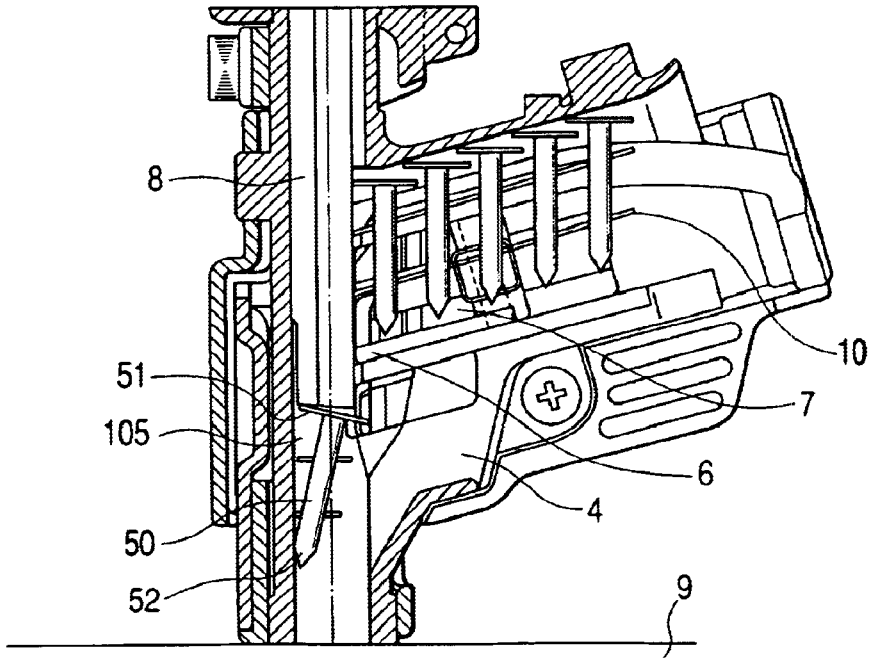
FIG. 11 PRIOR ART
Figure 12:
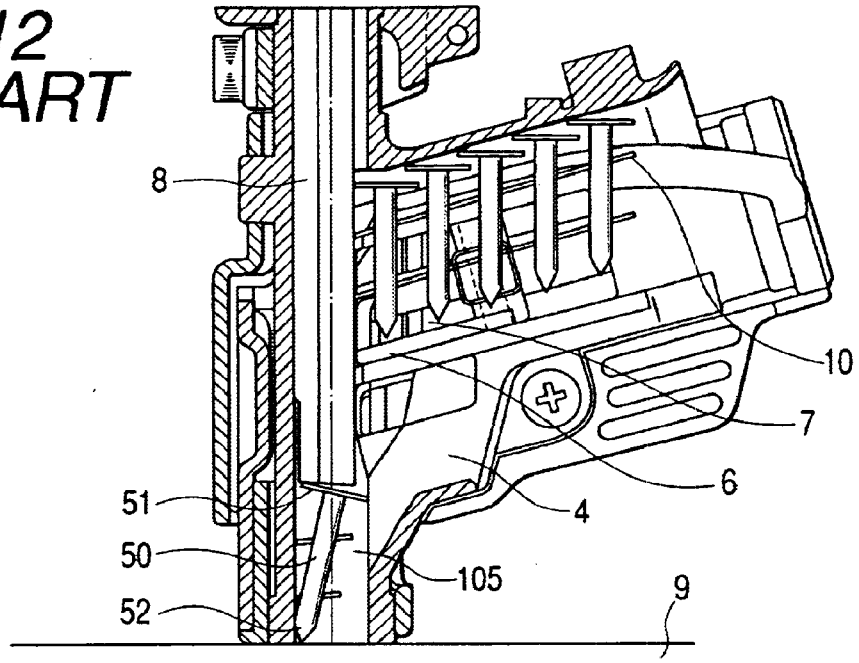
FIG. 12 PRIOR ART
Figure 13:
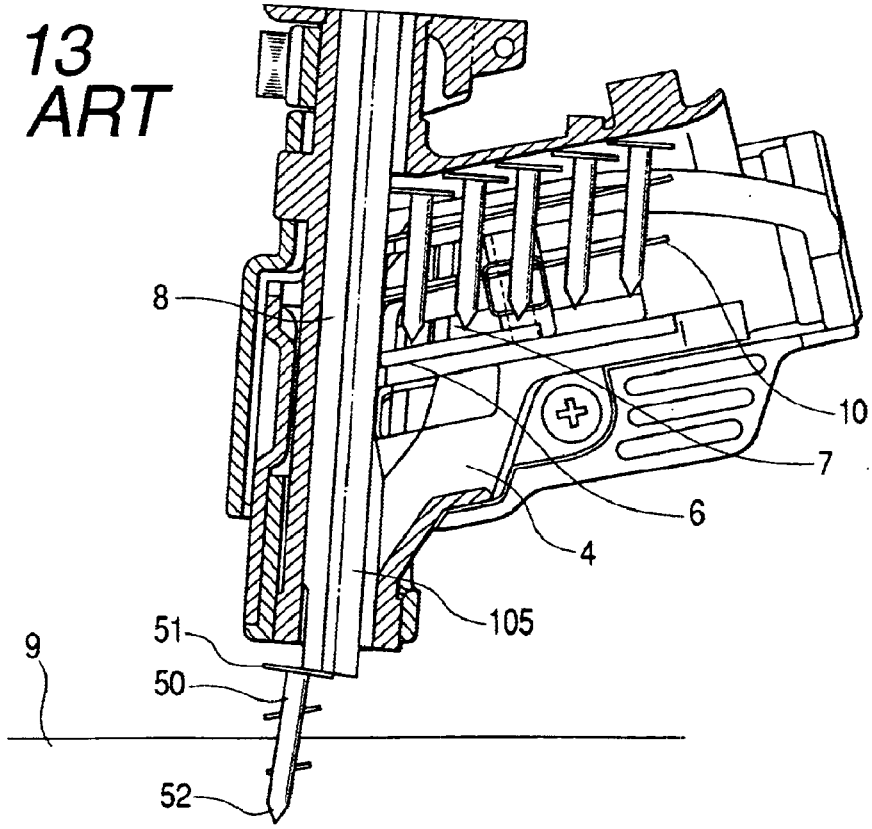
FIG. 13 PRIOR ART
Figure 14:
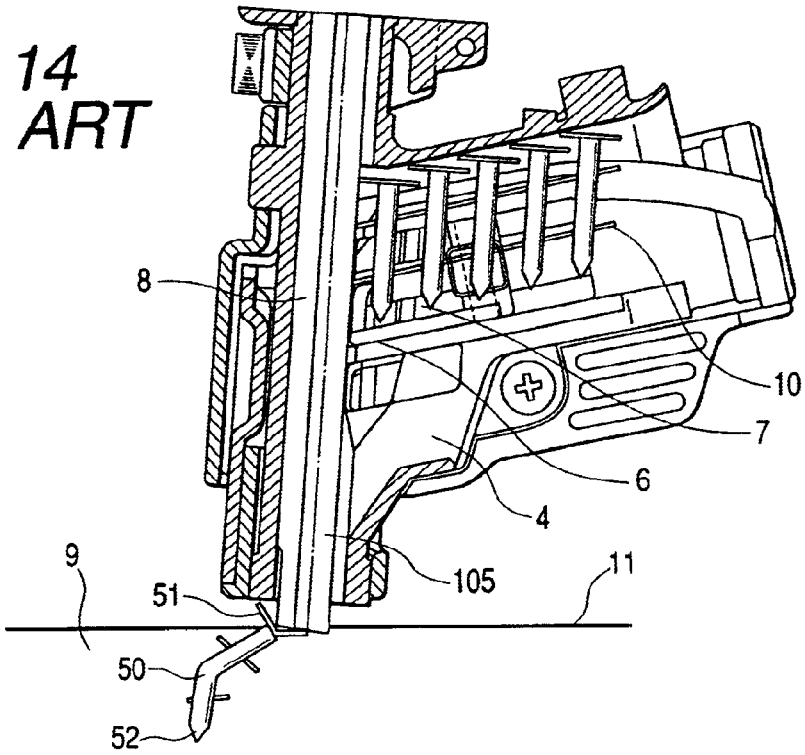
FIG. 14 PRIOR ART
Figure 15:
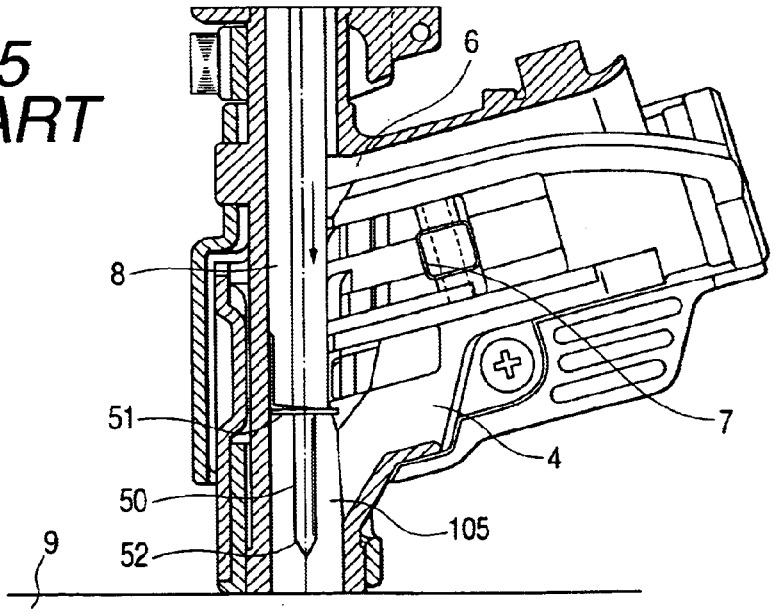
FIG. 15 PRIOR ART
Figure 16:
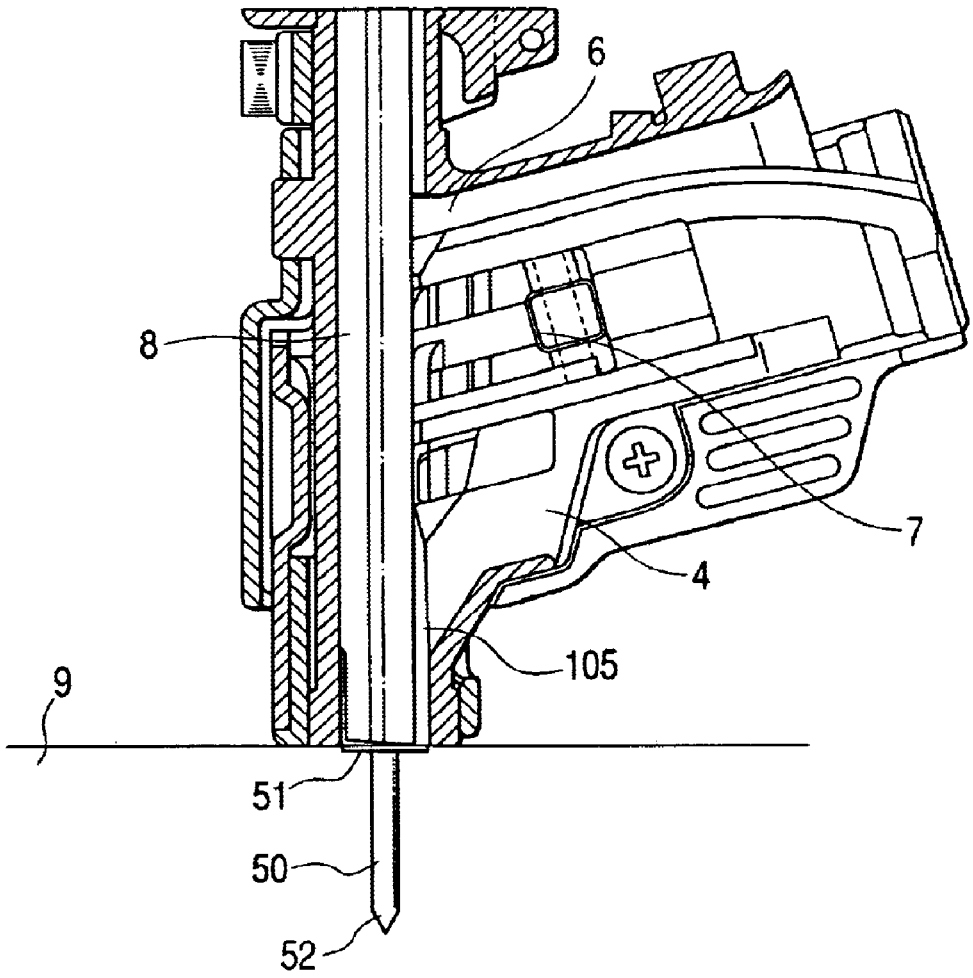
FIG. 16 PRIOR ART

FIG. 5 is a partial sectional view of the nose portion 4 according to the present invention, wherein the nail 50 is inclined, and the tip 52 of the nail 50 contacts with the second slope 21*a*. FIG. 6 is a partial sectional view of the nose portion 4 according to the present invention, wherein the tip 52 of the inclined nail 50 struck against the first slope 20*a*. FIG. 7 is a partial sectional view of the nose portion 4 according to the present invention, wherein the inclined nail 50 is correctly directed. FIG. 8 is a partial sectional view of the nose portion 4 according to the present invention, wherein the correctly directed nail 50 stuck in the board 9 perpendicularly.

In operation, the nails 50 are linked with wires and successively supplied to the nozzle 5 via the magazine 3 through an opening 6 at the rear portion of the nozzle 5 by a supplying mechanism 7 including an air cylinder, an air piston, or the like. The piston 8 is rapidly driven downwardly (in the drawings) in response to the trigger 31. Next, the piston 8 hits (drives) the supplied nail 50 so that the wires supporting the nail 50 are disconnected. The nail 50 travels downwardly through the nozzle 5.

The nail 50 travels along the inner surface 32 of the nozzle 5 so that almost all nails are driven into a board 9 perpendicularly to the board 9. However, the hit nail 50 may be inclined from the axis AX of the nozzle 5 as shown in FIG. 5. Such a nail 50 travels through the nozzle 5 with the tip 52 of the nail 50 contacting with the inner surface 32 of the nozzle 5.

When the tip 52 reaches to the taper 20, the tip 52 is directed to the axis AX of the nozzle 5 as shown by the arrow in FIG. 6. This makes the traveling direction of the nail 50 agreeing with the axis AX of the nozzle 5 just before the tip 52 reaches to the board 9 as shown in FIG. 7. Next, the nail 50 is driven into the board 9 perpendicularly as shown in FIG. 8.

It is favorable that the second (inclination) angle E between the second slope 21*a* and the axis AX is relatively small to smoothly guide the tip of the nail 50. On the other hand, the first (inclination) angle F between the first slope 20*a* and the axis AX is greater than the second angle E to change the direction of the nail 50. The inventor discovered this face and experimentally discovered the most favorable value of the first angle F is 15° and that of the second angle E is 20°.

The above-mentioned embodiment has been described with the example where the nail 50 is inclined as shown in FIG. 6. However, nails 50 inclined at any other direction can be correctly directed.

As mentioned above, the nails 50 are driven into the board 9 perpendicularly, so that the appearance is good and the holding power is sufficient.

What is claimed is:

1. A nail driver comprising:

a driving portion having a trigger and a piston coupled to a driving unit for driving a nail in a driving direction in response to said trigger;

a handle connected to said driving portion;

a tubular guide portion having an output nozzle for guiding said nail driven by said driving portion and outputting said nail through said output nozzle, an axis of said tubular guide portion being arranged in said driving direction; and a magazine connected to said tubular guide portion for supplying said nail to said tubular guide portion at an initial position defined by said driving portion with a sharp tip of said nail being directed in said driving direction, wherein an inner surface of said tubular guide portion has a taper extending in said driving direction near said output nozzle and being arranged downstream in said driving direction from said sharp tip of said nail at said initial position to direct said sharp tip of said nail toward an axis of said tubular guide portion when said tip of said nail contacts with said taper, wherein said inner surface further includes another taper extending in an opposite driving direction, provided upstream from said taper.

2. The nail driver as claimed in claim 1, wherein another cross-sectional area of said taper progressively increases in said driving direction.

3. The nail driver as claimed in claim 2, wherein said taper and said another taper are arranged coaxially with said axis of said tubular guide portion.

4. The nail driver as claimed in claim 1, wherein a first slope of said taper on a plane including said axis of said tubular guide portion makes a first angle with said axis and a second slope of said another taper on said plane makes a second angle with said axis, and said second angle is smaller than said first angle.

5. The nail driver as claimed in claim 4, wherein said first angle is about 15° and said second angle is about 2°.

6. The nail driver as claimed in claim 1, wherein a diameter of an upstream end of said another taper is equal to a diameter of a downstream end of said taper.

7. The nail driver as claimed in claim 1, wherein said taper and said another taper is successively connected.

8. A nail driver comprising:

a driving portion having a trigger and a piston coupled to a driving unit for driving a nail in a driving direction in response to said trigger;

a handle connected to said driving portion;

a tubular guide portion having an output nozzle for guiding said nail driven by said driving portion and outputting said nail through said output nozzle, an axis of said tubular guide portion being arranged in said driving direction; and a magazine connected to said tubular guide portion for supplying said nail to said tubular guide portion at an initial position defined by said driving portion with a sharp tip of said nail being directed in said driving direction, wherein an inner surface of said tubular guide portion has a taper extending in said driving direction near said output nozzle and being arranged downstream in said driving direction from said sharp tip of said nail at said initial position to direct said sharp tip of said nail toward an axis of said tubular guide portion when said sharp tip of said nail contacts with said taper, wherein said inner surface further includes another taper extending in an opposite driving direction, provided upstream from said taper, and wherein a first slope of said taper on a plane including said axis of said tubular guide portion makes a first angle with said axis and a second slope of said another taper on said plane makes a second angle with said axis, and said second angle is different from said first angle.

* * * * *